US010302277B2

(12) United States Patent
Song et al.

(10) Patent No.: US 10,302,277 B2
(45) Date of Patent: May 28, 2019

(54) MULTI-FACETED LENS

(71) Applicant: HYUNDAI MOBIS Co., Ltd., Seoul (KR)

(72) Inventors: Ki Ryong Song, Anyang-si (KR); Gun Duk Kim, Yongin-si (KR); Hyung Rok Shim, Seoul (KR)

(73) Assignee: Hyundai Mobis Co., Ltd., Seoul (KR)

( * ) Notice: Subject to any disclaimer, the term of this patent is extended or adjusted under 35 U.S.C. 154(b) by 0 days.

(21) Appl. No.: 16/001,447

(22) Filed: Jun. 6, 2018

(65) Prior Publication Data

US 2018/0356066 A1 Dec. 13, 2018

(30) Foreign Application Priority Data

Jun. 9, 2017 (KR) ..... 10-2017-0072272

(51) Int. Cl.
*F21V 5/04* (2006.01)

(52) U.S. Cl.
CPC ..... *F21V 5/04* (2013.01)

(58) Field of Classification Search
CPC ..... F21V 5/04
See application file for complete search history.

(56) References Cited

U.S. PATENT DOCUMENTS

2015/0345747 A1* 12/2015 Castillo ..... G02B 19/0028 362/297
2018/0058661 A1* 3/2018 Shim ..... F21V 5/04

* cited by examiner

*Primary Examiner* — Thomas M Sember
(74) *Attorney, Agent, or Firm* — H.C. Park & Associates, PLC

(57) ABSTRACT

Provided is a multi-faceted lens. The multi-faceted lens includes a light-receiver disposed in front of a light source, a total internal reflector disposed outside the light-receiver and equipped with a total internal reflection lens for collecting the light irradiated by the light source, and a light-transmitter disposed in front of the light-receiver to irradiate the light, supplied from the light-receiver and the total internal reflector, onto the outside. Light irradiated by the light source passes through the light-receiver.

6 Claims, 15 Drawing Sheets

(LIGHT PATH SMALLER THAN DIAMETER OF MULTI-FACETED LENS)

(LIGHT PATH EQUAL TO DIAMETER OF MULTI-FACETED LENS)

(LIGHT PATH GREATER THAN DIAMETER OF MULTI-FACETED LENS)

(STAGE 1)

(STAGE 2)

(STAGE 3)

(STAGE 4)

MULTI-FACETED LENS

CROSS-REFERENCE TO RELATED APPLICATIONS

This application claims priority from and the benefit of Korean Patent Application No. 10-2017-0072272, filed on Jun. 9, 2017, which is hereby incorporated by reference for all purposes as if set forth herein.

BACKGROUND

Field

Exemplary embodiments relate to a multi-faceted lens, and more particularly, to a multi-faceted lens in which a loss area of a total internal reflection part located in a light-receiving part is minimized to increase luminous efficiency.

Discussion of the Background

Generally, a light source such as a liquid crystal display (LCD) or a light emitting diode (LED) is used together with a lens when used as a lighting system or a driving beam headlamp of an automobile or the like.

In particular, up to now, an LED has been used mainly as a function of irradiating a wide range or illuminating a close range because it has characteristics in which light used in the illumination has a very large radiation angle.

When such an LED is used to irradiate a local region in a remote local area, the Etendue (light spreading) problem occurs due to its very large radiation angle, and thus luminous efficiency decreases significantly. Accordingly, in consideration of such characteristics, an LED is used together with a multi-faceted lens, which is a condensing lens for collecting light emitted by the LED or guiding light in a direction parallel to an optic axis.

To describe a related art multi-faceted lens 1 with reference to FIGS. 1 and 2, a main body 1 of the related art multi-faceted lens 1 is implemented based on different standards, and a light-receiving part which is configured by coupling a plurality of total internal reflection lenses is disposed on one side of the main body 1.

However, the related art multi-faceted lens has a problem in that luminous efficiency of a light source is low because total internal reflection is difficult to achieve in a dummy surface 4, which is the center of the light-receiving part.

The above information disclosed in this Background section is only for enhancement of understanding of the background of the invention and, therefore, it may contain information that does not constitute prior art.

SUMMARY

Exemplary embodiments of the present invention provide a multi-faceted lens in which the size and number of total internal reflection lenses are adjusted to minimize a fixed loss area of a total internal reflection part.

The present invention also provides a multi-faceted lens for preventing a glare phenomenon caused by an increase in number of total internal reflection lenses.

In one general aspect, a multi-faceted lens includes: a light-receiving part disposed in front of a light source, light irradiated by the light source passing through the light-receiving part; a total internal reflection part disposed outside the light-receiving part and equipped with a total internal reflection lens for collecting the light irradiated by the light source; and a light-transmitting part disposed in front of the light-receiving part to irradiate the light, supplied from the light-receiving part and the total internal reflection part, onto the outside.

The total internal reflection lens of the total internal reflection part may be provided as one or more.

The total internal reflection lens of the total internal reflection part may be provided narrower in area than the light-transmitting part.

A loss area of the total internal reflection lens in a portion deviating from an area of the light-transmitting part is calculated as expressed in the following Equation:

$$A_n=\{R_n^2\times\theta_n\}/2-\{R_n\times H\times\sin(\theta_n)\}/2,\theta_n=\arccos(H/R_n)-\theta_{n-1}$$

where An denotes a loss area of an nth-located total internal reflection lens deviating from the area of the light-transmitting part, Rn denotes a radius of the nth-located total internal reflection lens, H denotes a height of the multi-faceted lens, W denotes a width of the multi-faceted lens, $\theta n_{-1}$ denotes a cutting angle of an $n_{-1}$st-located total internal reflection lens, n denotes the nth-located total internal reflection lens, and $\theta n_{-1}$ is 0 when n=1.

In the one or more total internal reflection lenses, a diameter of a total internal reflection lens located in the outside may be greater than a diameter of a total internal reflection lens located in the inside.

The light-receiving part and the total internal reflection part may be provided as one body.

The light-transmitting part may include a plurality of lenses.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
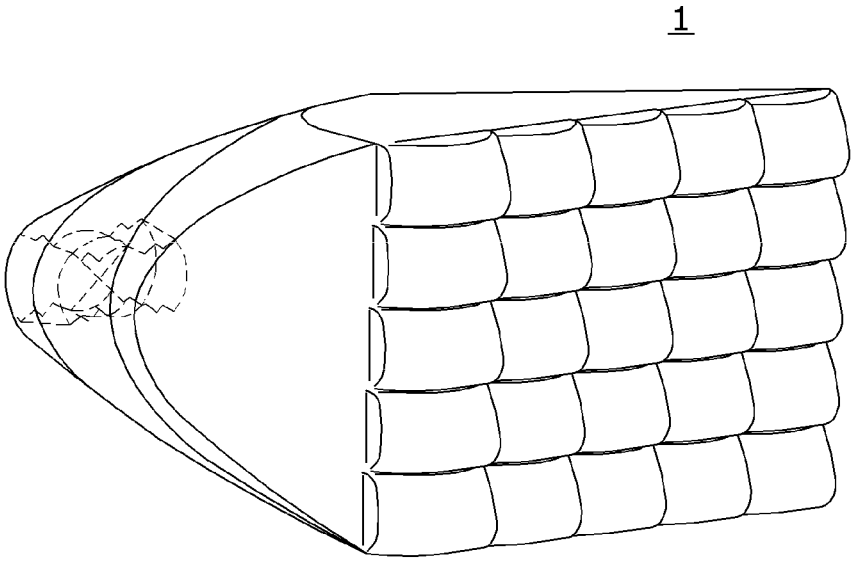
FIG. 1 is a perspective view of a related art multi-faceted lens.
Figure 2:
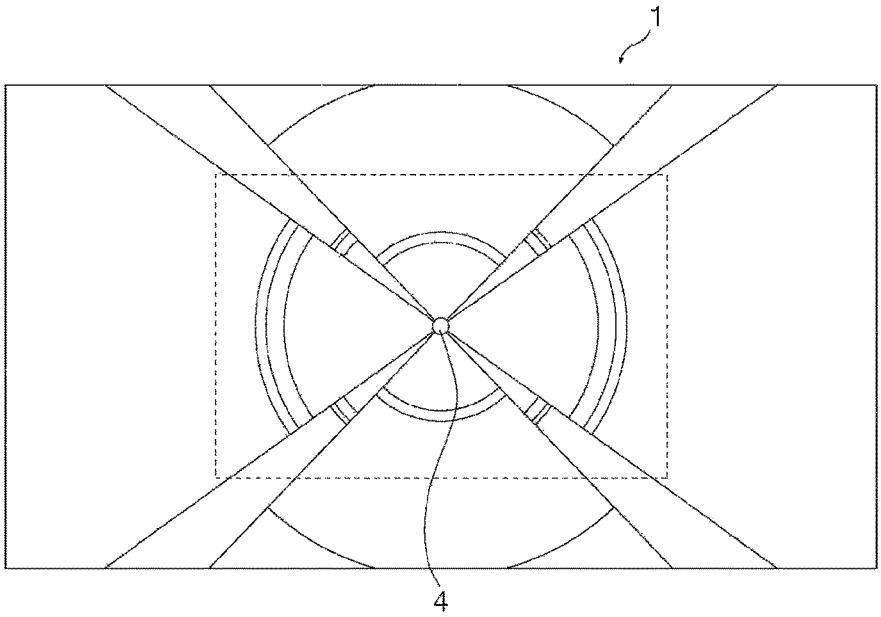
FIG. 2 is a rear view of the multi-faceted lens shown in FIG. 1.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. Like reference numerals in the drawings denote like elements.

Various advantages and features of the present invention and methods accomplishing thereof will become apparent from the following description of embodiments with reference to the accompanying drawings. However, the present invention is not be limited to the embodiments set forth herein but may be implemented in many different forms. The present embodiments may be provided so that the disclosure of the present invention will be complete, and will fully convey the scope of the invention to those skilled in the art and therefore the present invention will be defined within the scope of claims. Like reference numerals throughout the description denote like elements.

Unless defined otherwise, it is to be understood that all the terms (including technical and scientific terms) used in the specification has the same meaning as those that are understood by those who skilled in the art. Further, the terms defined by the dictionary generally used should not be ideally or excessively formally defined unless clearly defined specifically. It will be understood that for purposes of this disclosure, "at least one of X, Y, and Z" can be construed as X only, Y only, Z only, or any combination of two or more items X, Y, and Z (e.g., XYZ, XYY, YZ, ZZ). Unless particularly described to the contrary, the term "comprise", "configure", "have", or the like, which are described herein, will be understood to imply the inclusion of the stated components, and therefore should be construed as including other components, and not the exclusion of any other elements.

Hereinafter, exemplary embodiments of the present invention will be described in more detail with reference to the accompanying drawings.

Figure 3:
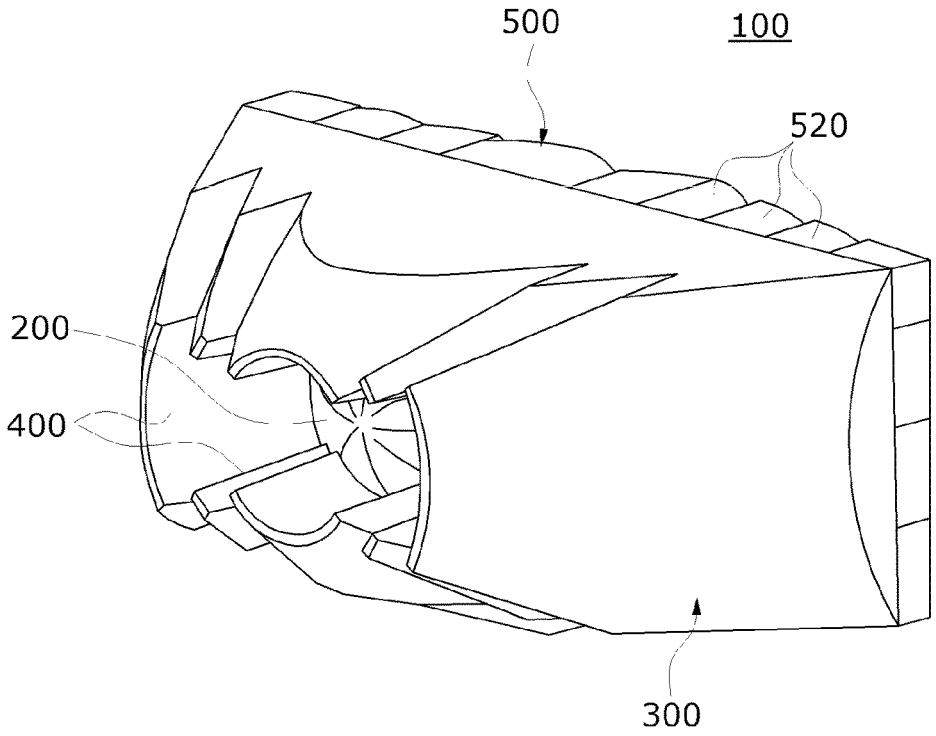
FIG. 3 is a perspective view showing a multi-faceted lens according to the present invention.
Figure 4:
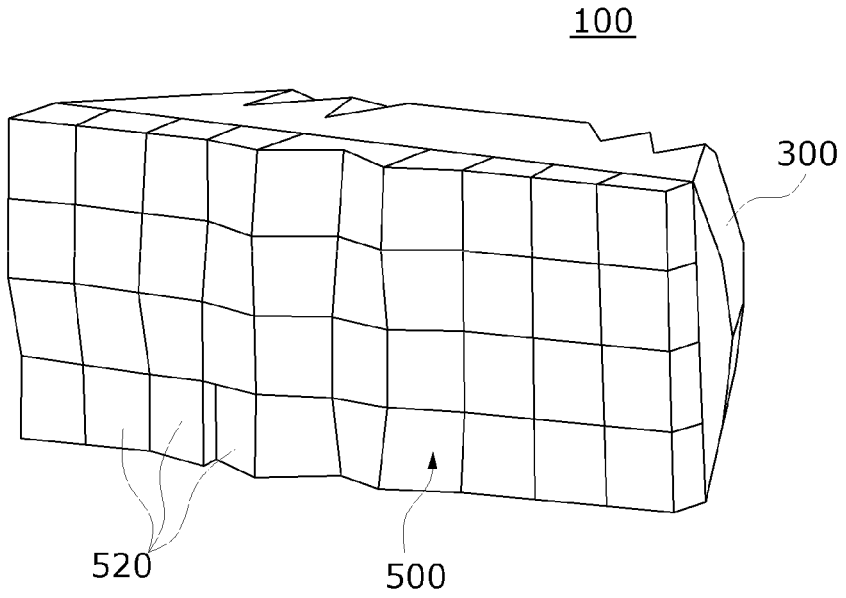
FIG. 4 is a rear perspective view showing a multi-faceted lens according to the present invention.

Hereinafter, exemplary embodiments of the present invention will be described in detail with reference to the accompanying drawings. FIG. 3 is a perspective view showing a multi-faceted lens according to the present invention, and FIG. 4 is a rear perspective view showing a multi-faceted lens according to the present invention.

A multi-faceted lens 100 according to the present invention includes a light-receiving part 200 through which light irradiated by a light source passes, a total internal reflection part 300 which is disposed outside the light-receiving part 200 and includes one or more total internal reflection lenses 400 for collecting the light irradiated by the light source, and a light-transmitting part 500 which is disposed in front of the light-receiving part 200 and irradiates the light, supplied from the light-receiving part 200 and the total internal reflection part 300, onto the outside.

That is, the multi-faceted lens 100 supplies the light irradiated by the light source to the light-receiving part 200 and the total internal reflection part 300, and the light-transmitting part 500 irradiates the light, supplied via the light-receiving part 200 and the total internal reflection part 300, onto a front region through a plurality of lenses 520.

Here, the light-receiving part 200 and the light-transmitting part 500 other than the total internal reflection part 300 having the total internal reflection lens 400 are not limited to those shown in the drawing, and may be formed in various shapes or in well-known configurations. Also, description thereof will be omitted.

Also, according to an embodiment of the present invention, a loss area is minimized by adjusting the size and number of the total internal reflection lenses 400 equipped in the total internal reflection part 300, thereby realizing optimized luminance efficiency.

To provide description with reference to FIG. 5, in the multi-faceted lens 100, luminous efficiency is determined based on a size of each the total internal reflection lenses 400.

That is, the total internal reflection lenses 400 should be designed in consideration of the light path and the diameter of the multi-faceted lens 100. In this case, optical loss occurs when the light path is greater than the diameter of the multi-faceted lens 100.

Figure 5A:
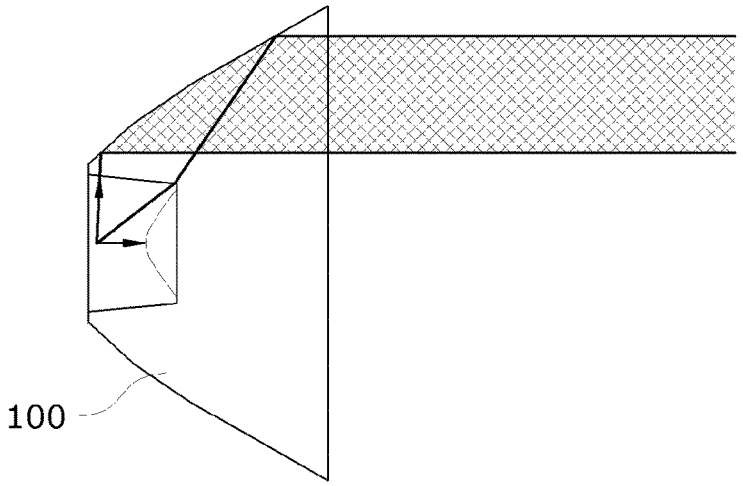
FIGS. 5A, 5B, and 5C are diagrams showing a relationship between a light path and a diameter of a multi-faceted lens according to the present invention.
Figure 5B:
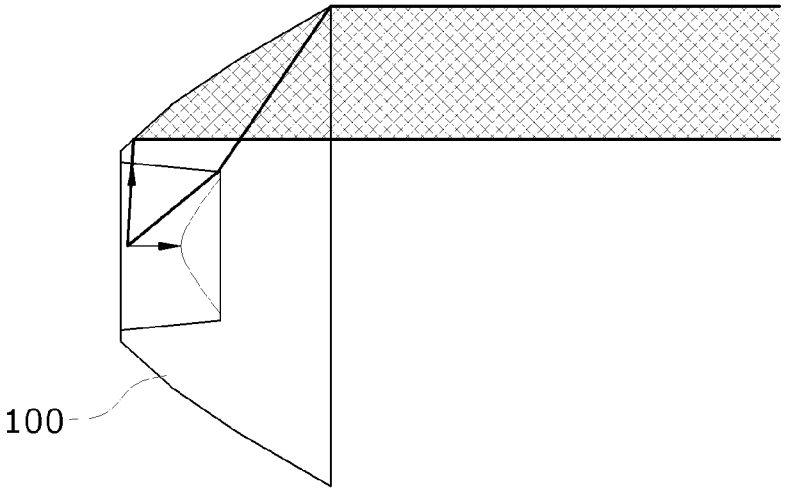
Figure 5C:
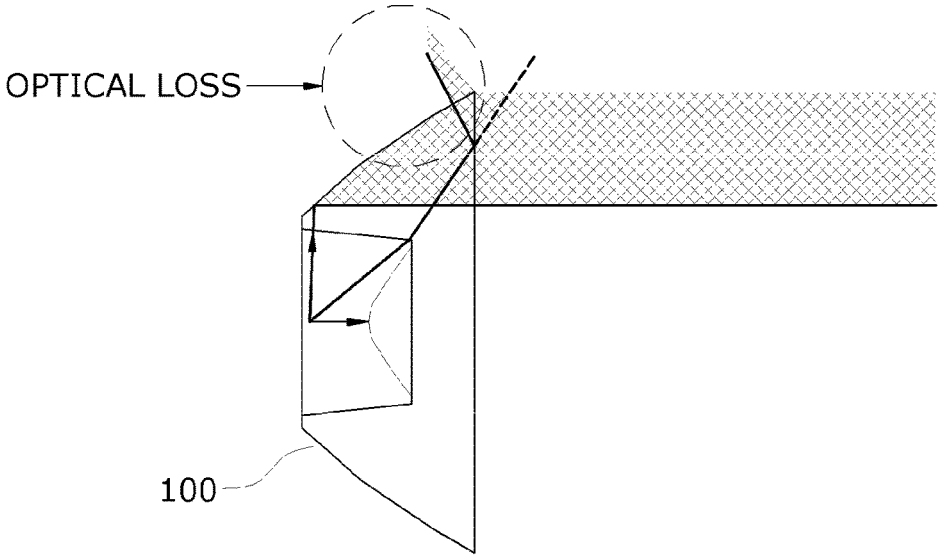

In detail, optical loss does not occur in a case where the light path is less than a diameter of the multi-faceted lens 100 as in FIG. 5A and a case where the light path is equal to the diameter of the multi-faceted lens 100 as in FIG. 5B, and optical loss occurs in a case where the light path is greater than the diameter of the multi-faceted lens 100 as in FIG. 5C.

Moreover, the luminance intensity and luminance efficiency of the multi-faceted lens 100 are inversely proportional to each other, based on a diameter of each of the total internal reflection lenses 400.

Figure 6:
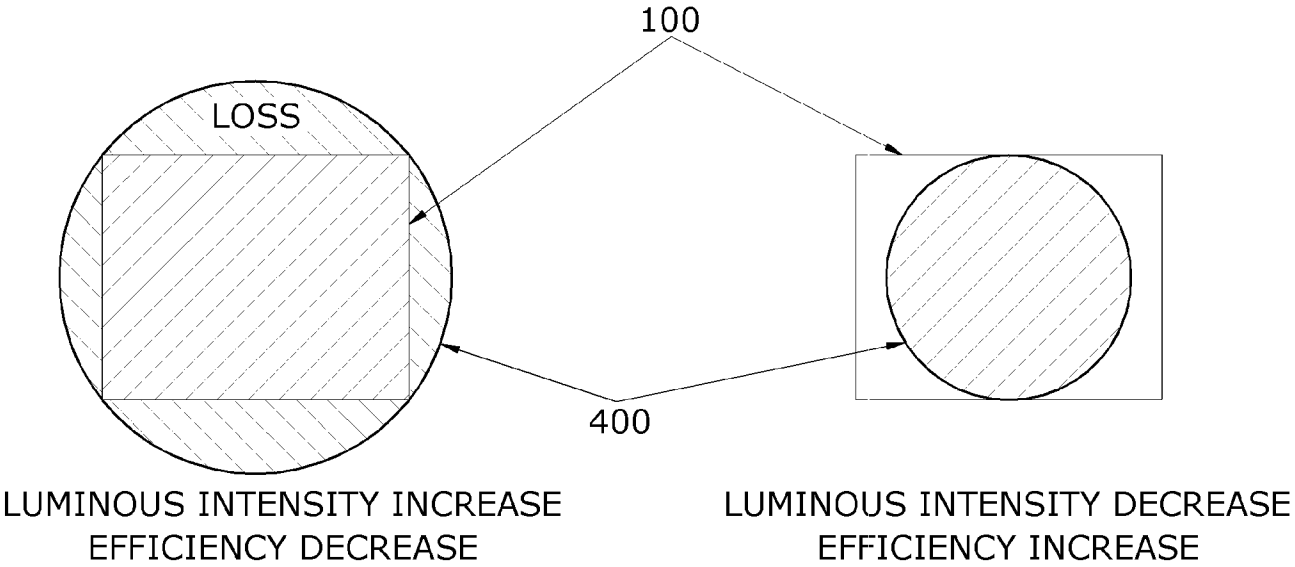
FIG. 6 is a diagram showing a relationship between luminance efficiency and luminous intensity according to a ratio of a light path to a diameter of a multi-faceted lens according to the present invention.

Referring to FIG. 6, if the diameter of each of the total internal reflection lenses 400 is greater than the diameter of the multi-faceted lens 100, the luminous intensity increases, but the luminance efficiency decreases. On the other hand, if the diameter of each of the total internal reflection lenses 400 is less than the diameter of the multi-faceted lens 100, the luminous intensity decreases, but the luminance efficiency increases.

Hereinafter, a process of designing a total internal reflection lens 400 in order to increase the luminous efficiency of the multi-faceted lens 100 will be described.

First, one or more total internal reflection lenses 400 are provided in the total internal reflection part 300 with respect to the light source disposed behind the light-receiving part 200.

Herein, an example where the total internal reflection lens 400 is provided as ten or less will be described.

Figure 8A:
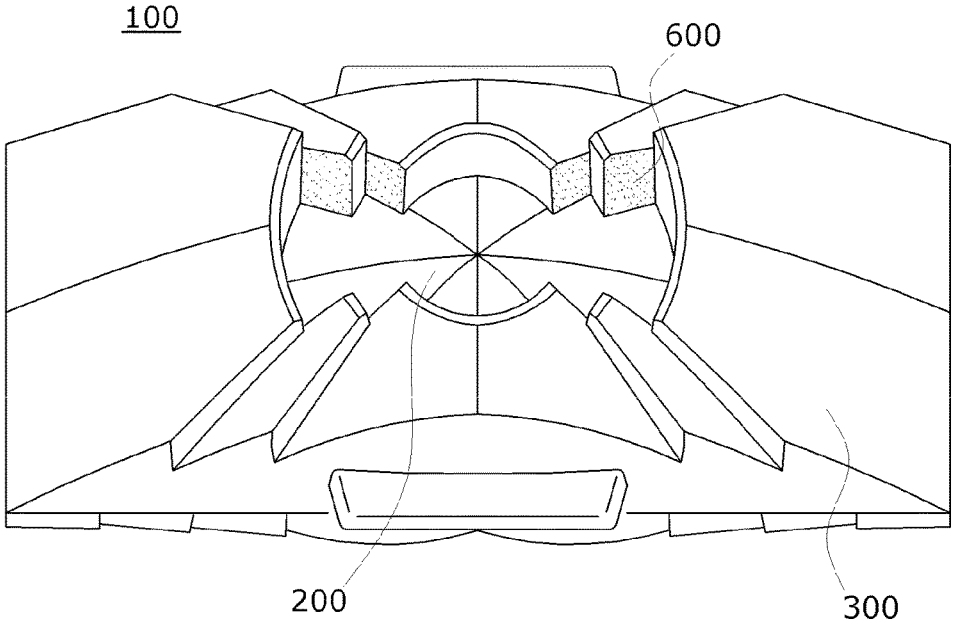
FIGS. 8A and 8B are bottom perspective views showing parts where glare occurs when total internal reflection lenses configuring a multi-faceted lens according to the present invention operate.
Figure 8B:
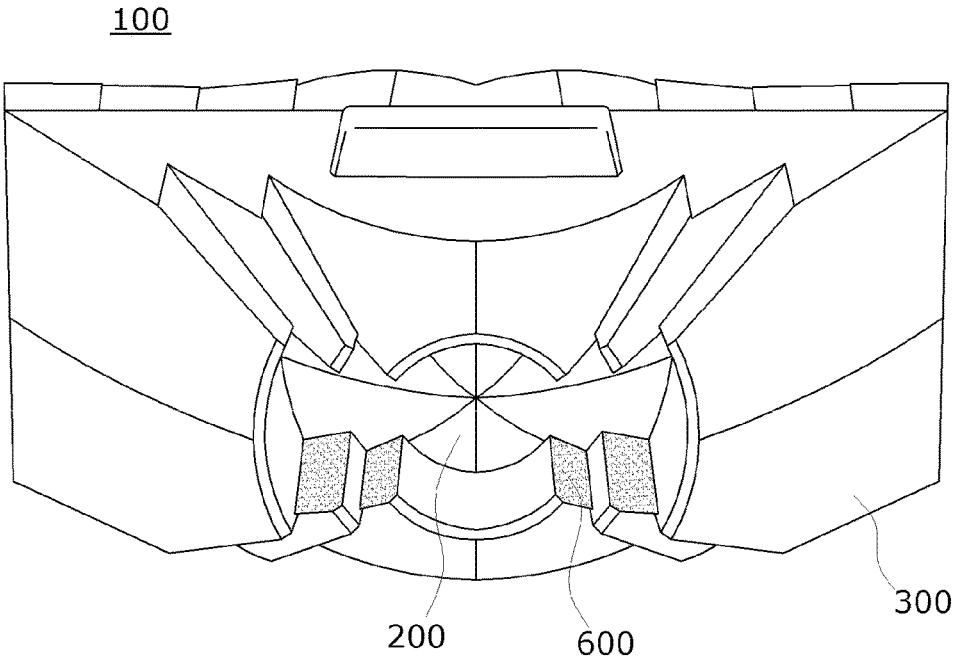
Figure 9A:
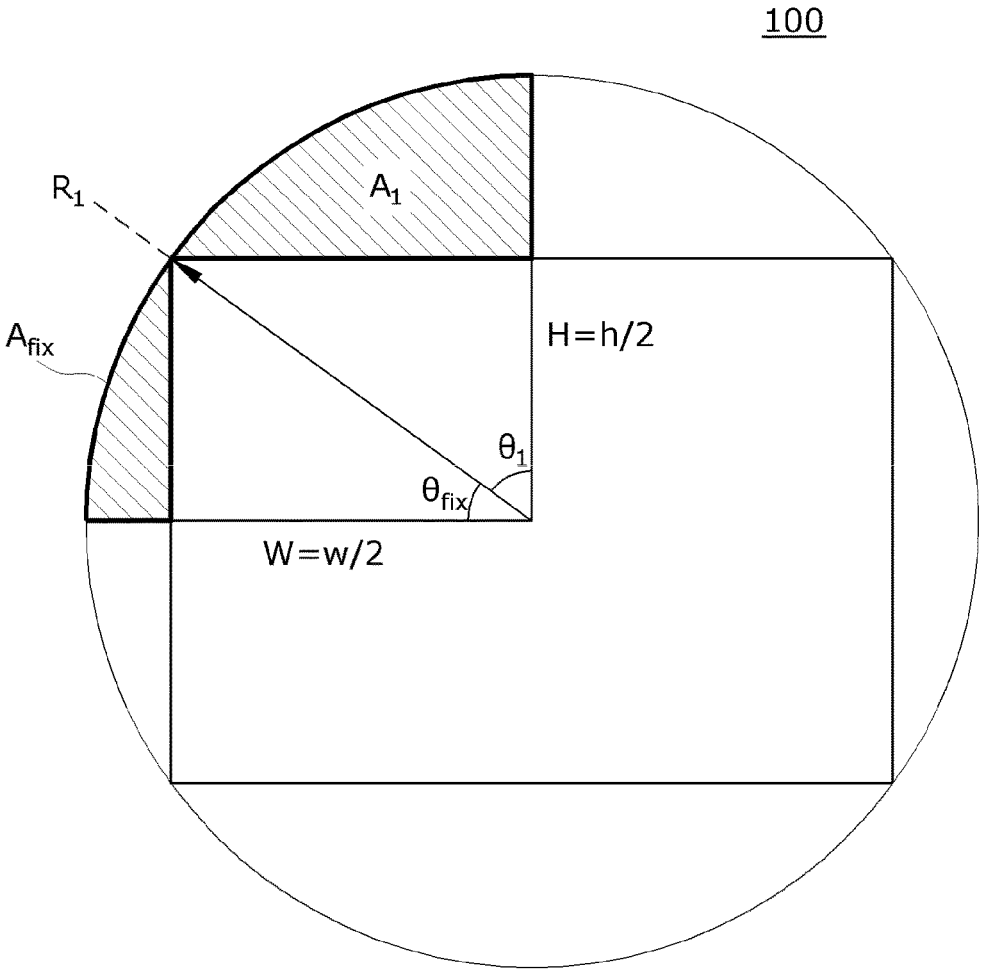
FIGS. 9A, 9B, 9C, and 9D are diagrams showing an embodiment where total internal reflection lenses configuring a multi-faceted lens according to the present invention are designed.
Figure 9B:
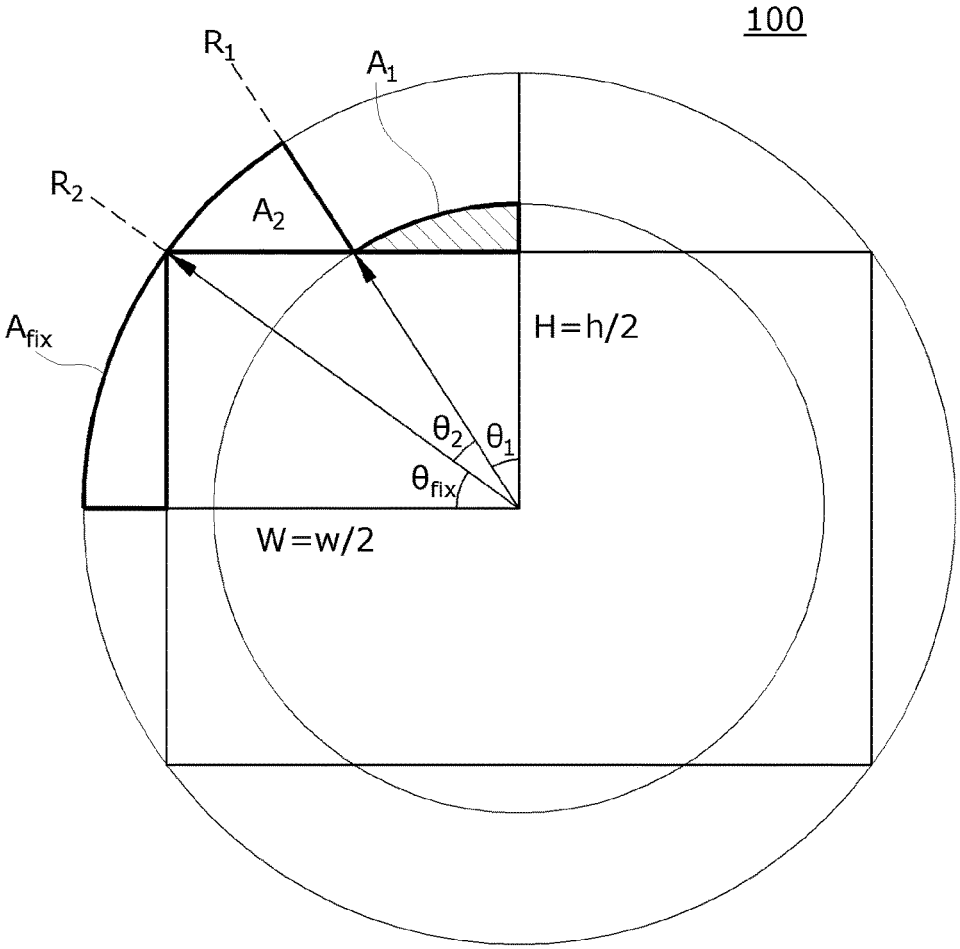
Figure 9C:
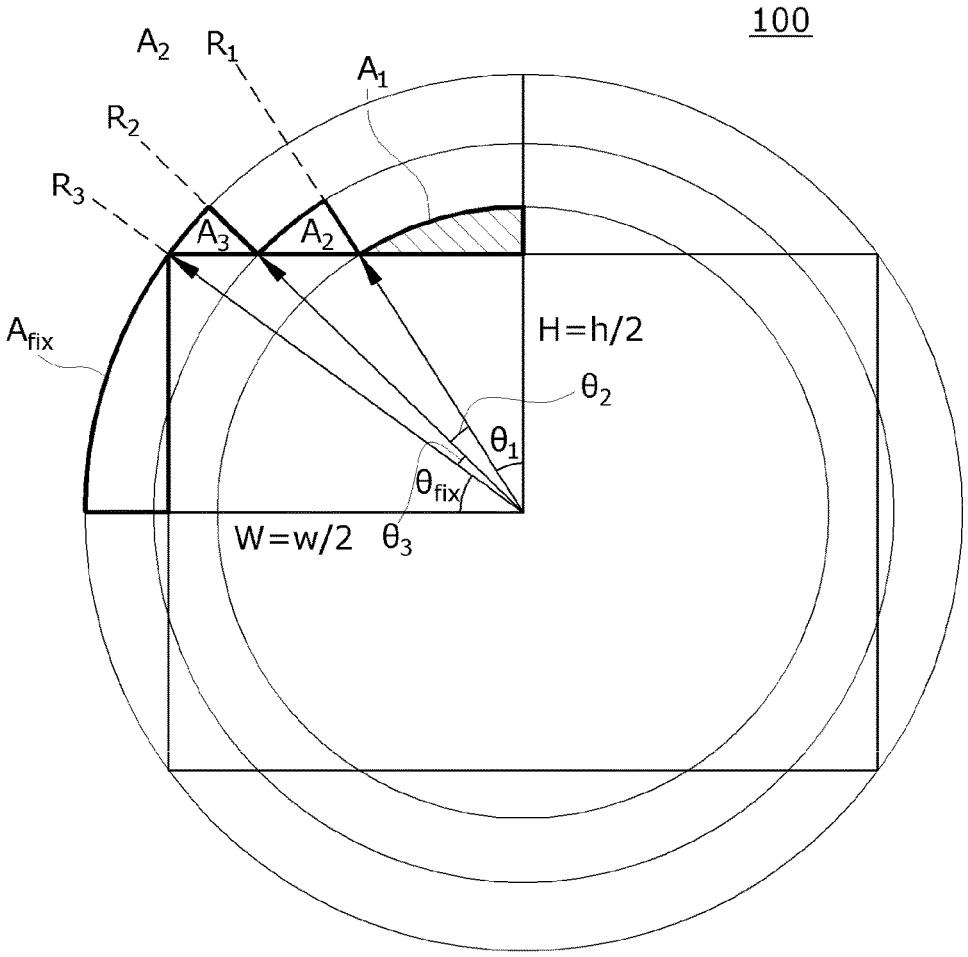
Figure 9D:
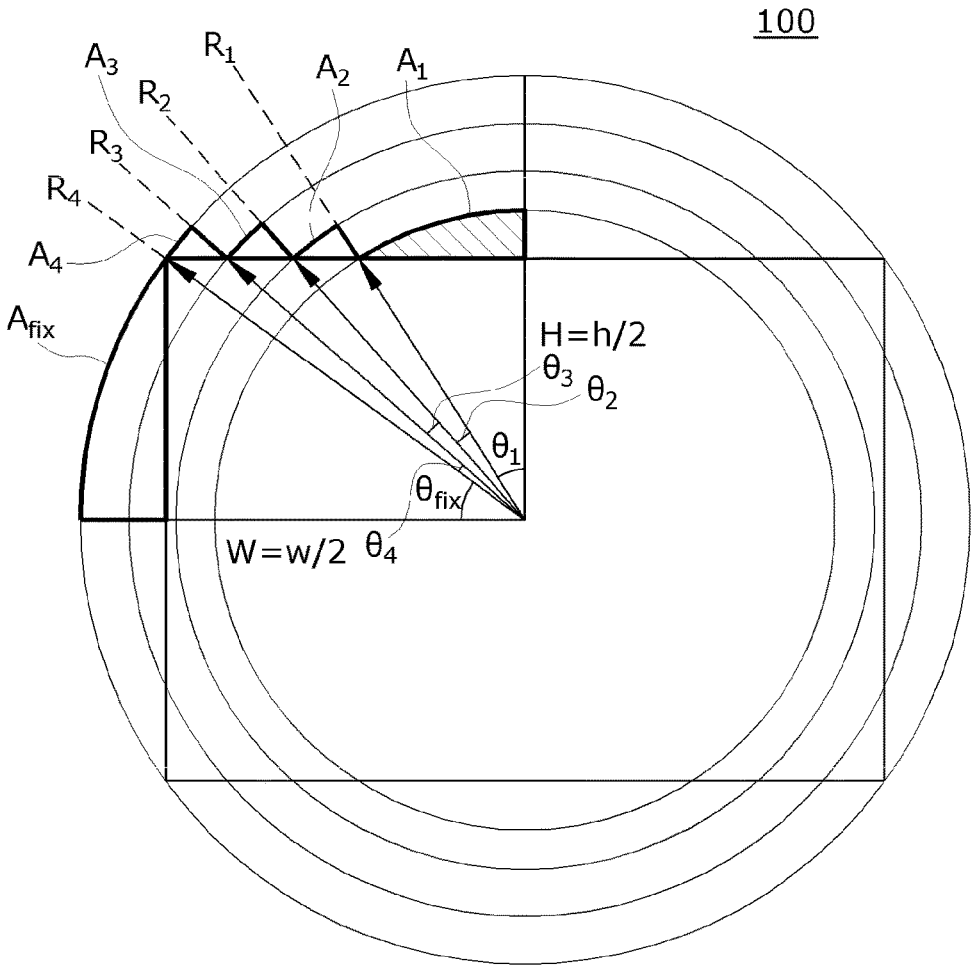

To provide description with reference to FIGS. 8A and 8B, as the number of the total internal reflection lenses 400 increases, a glaring surface 600 is enlarged, and thus, it is effective that the total internal reflection lens 400 is provided as ten or less.

Also, the total internal reflection lens 400 is provided less than an area of the light-transmitting part 500.

That is, as shown in FIGS. 9A to 9D, the total internal reflection lenses 400 are designed by deriving a radius value that minimizes the sum of areas thereof, and total internal reflection lenses 400 located in the inside are provided to have smaller diameters than total internal reflection lenses 400 located in the outside.

A loss area of a total internal reflection lens 400 in a portion deviating from the area of the light-transmitting part 500 is calculated as expressed in the following Equation (1):

$$A_n=\{R_n^2\times\theta_n\}/2-\{R_n\times H\times\sin(\theta_n)\}/2,\theta_n=\arccos(H/R_n)-\theta_{n-1} \quad (1)$$

where $A_n$ denotes a loss area of an nth-located total internal reflection lens deviating from the area of the light-transmitting part, $R_n$ denotes a radius of the nth-located total internal reflection lens, H denotes a height of the multi-faceted lens, W denotes a width of the multi-faceted lens, $\theta_{n-1}$ denotes a cutting angle of an $n_{-1}$st-located total internal reflection lens, and n denotes the nth-located total internal reflection lens. When n=1, $\theta_{n-1}=0$.

To provide an additional description, in designing a loss area of each of the total internal reflection lenses 400, the loss area may be calculated in the following process. Here, an example which calculates the loss area in designing first up to fourth stages will be described with reference to the following Equations (2) to (5):

$$A_1=\{R1^2\times\theta_1\}/2-\{R_1\times H\times\sin(\theta_1)\}/2,\theta_1=\arccos(H/R_1) \quad (2)$$

$$A_2=\{R2^2\times\theta_2\}/2-\{R_2\times H\times\sin(\theta_2)\}/2,\theta_2=\arccos(H/R_2)-\theta_1 \quad (3)$$

$$A_3=\{R3^2\times\theta_3\}/2-\{R_3\times H\times\sin(\theta_3)\}/2,\theta_3=\arccos(H/R_3)-\theta_2-\theta_1 \quad (4)$$

$$A_4=\{R4^2\times\theta_4\}/2-\{R_4\times H\times\sin(\theta_4)\}/2,\theta_4=\arccos(H/R_4)-\theta_3-\theta_2-\theta_1 \quad (5)$$

That is, the luminance efficiency of the total internal reflection lenses 400 are optimized by adjusting the number of the total internal reflection lenses 400 and adjusting an Rn value and a $\theta n_{-1}$ value in the loss area of each of the total internal reflection lenses 400.

Figure 7:
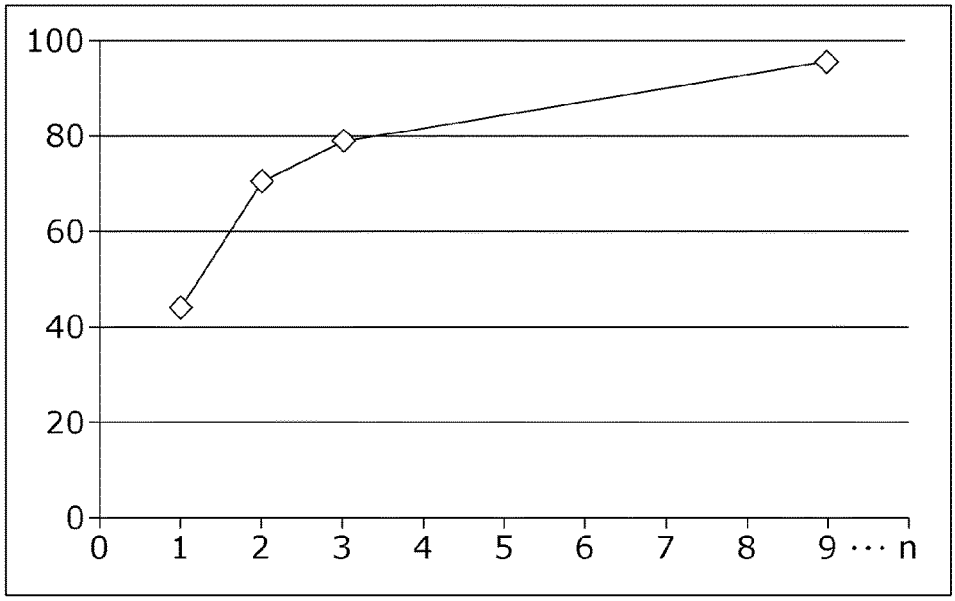
FIG. 7 is a graph showing a relationship between luminance efficiency and the number of total internal reflection lenses configuring a multi-faceted lens according to the present invention.

To provide an additional description, as in the graph of FIG. 7, the loss area "An" corresponds to a portion into which a mounting structure of the multi-faceted lens is inserted, and there is a fixed loss area of each of the total internal reflection lenses 400. Accordingly, as the area of each of the total internal reflection lenses 400 is infinitely enlarged, luminance efficiency of 95% is obtained.

As described above, in the multi-faceted lens according to the embodiments of the present invention, the size and number of the total internal reflection lenses may be adjusted to minimize a fixed loss area of the total internal reflection part, thereby increasing luminance efficiency.

Moreover, the multi-faceted lens according to the embodiments of the present invention prevents a glare phenomenon caused by an increase in number of the total internal reflection lenses.

The above-described subject matter of the present invention is to be considered illustrative and not restrictive, and it should be understood that numerous other modifications and embodiments can be devised by those skilled in the art without departing from the spirit and scope of the present invention. Accordingly, the embodiments of the present invention are to be considered descriptive and not restrictive of the present invention, and do not limit the scope of the present invention. The scope of the invention should be to be construed by the appended claims, and all technical ideas within the scope of their equivalents should be construed as being included in the scope of the invention. A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A multi-faceted lens comprising:

a light-receiver disposed in front of a light source, light irradiated by the light source passing through the light-receiver;

a total internal reflector disposed outside the light-receiver and equipped with a total internal reflection lens to collect the light irradiated by the light source; and a light-transmitter disposed in front of the light-receiver to irradiate the light onto the outside, wherein the light is supplied from the light-receiver and the total internal reflector;

wherein a loss area of the total internal reflection lens in a portion deviating from an area of the light-transmitter is calculated as expressed in Equation:

$$An=\{Rn2\times\theta n\}/2-\{Rn\times H\times\sin(\theta n)\}/2,\theta n=\arccos(H/Rn)-\theta n-1$$

wherein An denotes a loss area of an nth-located total internal reflection lens deviating from the area of the light-transmitter, Rn denotes a radius of the nth-located total internal reflection lens, H denotes a height of the multi-faceted lens, W denotes a width of the multi-faceted lens, θn−1 denotes a cutting angle of an n−1st-located total internal reflection lens, n denotes the nth-located total internal reflection lens, and θn−1 is 0 when n=1.

2. The multi-faceted lens of claim 1, wherein the total internal reflection lens of the total internal reflector comprises a plurality of total internal reflection lenses.

3. The multi-faceted lens of claim 2, wherein a diameter of a total internal reflection lens located on the outside is greater than a diameter of a total internal reflection lens located in an inside.

4. The multi-faceted lens of claim 1, wherein the total internal reflection lens of the total internal reflector is provided narrower in area than the light-transmitter.

5. The multi-faceted lens of claim 1, wherein the light-receiver and the total internal reflector are provided as one body.

6. The multi-faceted lens of claim 1, wherein the light-transmitter comprises a plurality of lenses.

* * * * *